United States Patent [19]

Pardo

[11] Patent Number: 4,735,022

[45] Date of Patent: Apr. 5, 1988

[54] CONCRETE MASONRY BLOCK AND STUD WALL CONSTRUCTION SYSTEM

[75] Inventor: Jorge Pardo, Reston, Va.

[73] Assignee: National Concrete Masonry Association, Herndon, Va.

[21] Appl. No.: 630,852

[22] Filed: Jul. 13, 1984

[51] Int. Cl.[4] ..... E04F 17/00

[52] U.S. Cl. ..... 52/221; 52/405; 52/434; 52/609; 174/48

[58] Field of Search ..... 52/348, 349, 433–440, 52/443, 561, 562, 568–572, 589–592, 596–599, 609–612, 672, 741–743, 745–748, 780, 781, 404, 354, 405, 408, 508, 763; 174/48

[56] References Cited

U.S. PATENT DOCUMENTS

| | | | |
|---|---|---|---|
| 415,605 | 11/1889 | Blatchford | 52/510 |
| 710,830 | 10/1902 | Zimmermann et al. | 52/763 |
| 802,556 | 10/1905 | Depew et al. | 52/763 |
| 892,225 | 6/1908 | Collins | 52/477 |
| 1,267,747 | 5/1918 | Comerma | 52/561 |
| 1,428,470 | 9/1922 | Brainerd | 52/780 |
| 1,842,828 | 1/1932 | Giuliani | 52/763 |
| 1,885,496 | 11/1932 | Venzie | 52/435 |
| 1,921,518 | 8/1933 | Frobisher | 52/407 |
| 2,094,635 | 10/1937 | Brooks | 52/489 |
| 2,163,381 | 6/1939 | Marsan | 52/598 |
| 2,249,073 | 7/1941 | Williamson | 52/408 |
| 2,299,908 | 10/1942 | Leash | 52/741 |
| 3,435,581 | 4/1969 | Ahlquist | 52/401 |
| 3,896,960 | 7/1975 | Schindler et al. | 220/3.5 |
| 3,924,056 | 12/1975 | Locicero | 174/48 |
| 4,124,062 | 11/1978 | Anderson et al. | 165/2 |
| 4,148,166 | 4/1979 | Toone | 52/309.12 |
| 4,241,782 | 12/1980 | Schoenfelder | 165/10 |

FOREIGN PATENT DOCUMENTS

| | | | |
|---|---|---|---|
| 163015 | 9/1948 | Austria | 52/434 |
| 910721 | 3/1954 | Fed. Rep. of Germany | 52/434 |
| 78922 | 8/1962 | France | 52/434 |
| 2414595 | 9/1979 | France | 52/282 |
| 89501 | 6/1921 | Switzerland | 52/568 |
| 155054 | 6/1932 | Switzerland | 52/780 |

OTHER PUBLICATIONS

Engineering News—Record, "Tilt—up Block Walls Insulate Warehouse", May 17, 1951, pp. 28, 29.

*Primary Examiner*—John E. Murtagh
*Assistant Examiner*—Andrew J. Rudy
*Attorney, Agent, or Firm*—Lowe, Price, Leblanc, Becker & Shur

[57] ABSTRACT

Certain types of interior concrete masonry block and stud wall constructions, and blocks for making the same, so as to provide improved thermal storage properties, improved heating and cooling and other advantages are disclosed. A preferred embodiment relates to modification of conventional interior lightweight stud wall construction systems which are in wide spread use and typically comprise lumber or steel stud framing covered by wall board with or without insulation installed within the wall. In such embodiment disclosed concrete masonry blocks are used as part of the wall by mounting the blocks between the studs and wall board. The concrete masonry blocks provide thermal storage capabilities so that the walls thus constructed store heat whereby temperature swings are attenuated and heating and/or cooling cycles are spaced at longer intervals to achieve more comfortable temperature conditions with resultant energy savings also. Also, preferred configurations of such concrete masonry blocks are provided whereby electrical junction boxes, cables, etc., may be installed within the stud wall framing and wall board. The nature of the concrete masonry blocks and the method of assembly in a stud wall are such that the walls can be mechanically constructed by unskilled workers rather than by skilled expensive masonry artisans. Also, such blocks can be used to retrofit to existing walls as well as to make new walls.

13 Claims, 1 Drawing Sheet

Fig. 1
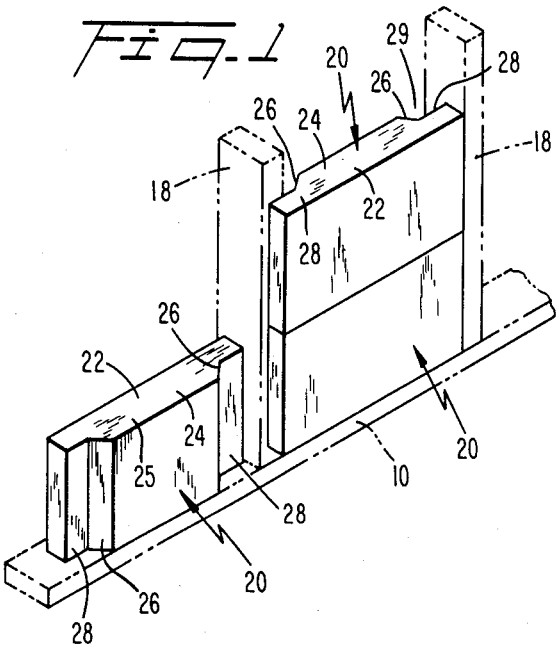
Fig. 2
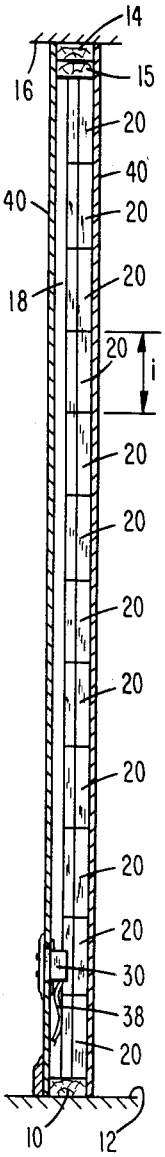
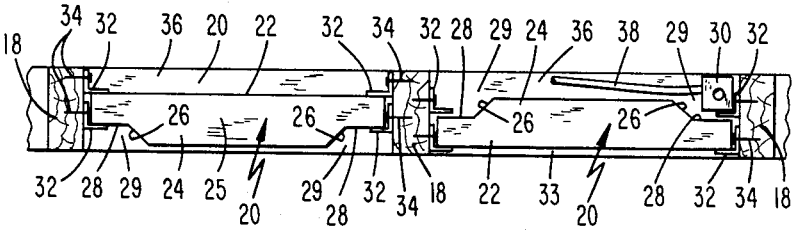
Fig. 3
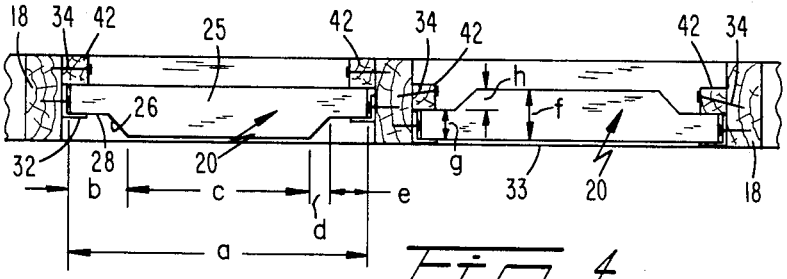
Fig. 4

CONCRETE MASONRY BLOCK AND STUD WALL CONSTRUCTION SYSTEM

DESCRIPTION

The present invention relates to certain types of stud wall construction incorporating concrete masonry blocks which provide mass to improve thermal storage properties and provide improved heating and cooling characteristics plus other advantages discussed below.

Lightweight wall construction systems, as exemplified by stud wall construction, are in widespread use in the United States. Conventional stud wall construction typically comprises lumber framing including a series of 2 by 4 wood studs, generally $1\frac{1}{2}\times3\frac{1}{2}$ inches in cross-sectional size; such studs extend vertically between, and are secured to, a lower stud plate on the floor and double upper stud plates at the ceiling. Sometimes the studs are made of sheet metal having a C-shaped cross-section, instead of wood, with a like cross-section size. In conventional stud wall construction the walls are finished by securing to the studs gypsum board, plywood, plaster or the like (called "wall board" for convenience); and sometimes insulation of various types is installed between the studs and the wall boards. Despite their apparent advantages for acceptance of utilities and speed of erection, etc., such lightweight wall systems exemplified by stud wall construction lack the mass required to store sufficient thermal energy to effectively attenuate undesirable temperature swings within a building. Even if such a conventional lightweight stud wall construction is provided with insulation within the wall between the studs and wall boards, there is virtually no capacity for heat storage. As a result the building heater and/or air conditioner is required to operate through wide temperature swings in relatively rapid cycles in order to maintain the desired average temperature cycle. On the other hand, in the stud wall construction of the present invention concrete masonry blocks are used as part of the wall and they provide thermal storage capabilities so that the walls store heat; as a result, temperature swings are attenuated and the heating and/or cycles are spaced to longer intervals to achieve more comfortable temperature conditions. The thermal storage capabilities of the concrete masonry blocks used in the modified stud walls according to the present invention therefore allow a more efficient utilization of heating and/or cooling systems with resultant energy savings while providing more comfortable conditions both in winter and summer. This is an advantage distinct from, and not achieved as such by, the use of thermal insulation materials such as typically installed within conventional stud wall constructions as above discussed.

There is available to the construction industry blocks of plastic which are filled with water and sized so that the blocks can be installed between the studs of a conventional stud wall. However, such water filled plastic blocks are subject to certain problems in that they may leak with resultant growth of algae and/or fungus. Also, the plastic blocks may be inadvertently penetrated by nails or other sharp objects in the field, causing leakage and requiring replacement. Additionally, the plastic containers are combustible and create increased fire hazard and are likely to cause noxious fumes in event of fire.

There is also offered to the construction industry blocks made of plastic and filled with a formulated calcium chloride hexahydrate compound or other phase change materials ("formulated compounds"); and such blocks are sized so that they can be installed between the studs of a conventional wall stud. The blocks containing such formulated compounds are intended to store an increased amount of thermal energy within a given space and volume as compared to water due to the properties of such formulated compound. The plastic enclosed block with such compound is subject to leakage. Also, the combustible plastic encasing material increases the hazards of fire and is likely to cause noxious fumes in event of fire. The formulated compound may start to crystalize after awhile thereby limiting the useful life of such blocks. Also such formulated compounds have a melting point of around 81 degrees F., whereas the ambient temperature indoors is generally less than 81 degrees so that optimum use of the formulated compound for storage of heat is not realized.

Both the plastic plus water blocks and the plastic plus formulated compound blocks are relatively expensive, especially as compared to the concrete masonry blocks for stud wall construction according to the present invention.

The present invention provides a novel stud wall construction using a new type of concrete masonry block which has a quite high density and mass since the block is made of high density cementitious materials, whereby such concrete masonry blocks will absorb substantial quantities of heat. Further, such concrete masonry blocks can be made with existing equipment and materials at a substantially lower cost then the above-discussed plastic plus water block and/or the above-discussed plastic plus formulated compound block. The concrete masonry blocks for stud walls according to this invention also avoid or overcome other shortcomings of such prior type energy absorption storage panels discussed herein.

The stud wall and concrete masonry block constructions according to this invention can be readily constructed by dry mechanical assembly of the concrete masonry blocks by unskilled workers without mortar. The concrete masonry blocks are secured between and to the studs by wood strips and/or metal angles of suitable size. This eliminates the need for more expensive bricklayers or other masonry artisans. In fact, the installation of the blocks within such stud walls can be "do-it-yourself".

The concrete masonry blocks (sometimes called "CM blocks") have a configuration so that when the blocks are installed between studs their configuration permits the installation and nailing of electrical junction boxes secured to the studs, and the running of cables or conduits within the cavity of the stud wall in which such CM blocks are installed.

The CM blocks also provide improved accoustical characteristics for stud walls incorporating same as herein disclosed.

Also such type of wall constructions can be used to retrofit to existing stud walls. That would be done by simply removing one (or both) conventional wall board surfaces, and proceeding in a manner as discussed herein.

The disclosed concrete masonry blocks for use in said stud wall construction disclosed in the drawings and described below can be made with standard existing equipment by ready modification of conventional concrete block machine molds. This is an important advantage for commercialization of these inventions.

A principal object of the present invention is to provide a novel modification of existing lightweight stud wall construction systems wherein concrete masonry blocks are used as part of the wall to provide thermal storage capabilities and achieve better heating, and cooling with energy savings and other advantages discussed herein.

Other objects of the present invention are to provide a new improved stud wall and CM block construction made with new CM blocks so as to accomplish various other objectives and advantages discussed above.

The above and other related objects and advantages of the present invention will become apparent from the following description and specification, appended claims and drawings.

In the Drawings

FIG. 1 is a perspective view of part of a conventional lightweight stud wall which however incorporates concrete masonry blocks between the studs and within the usual wallboard in a construction according to the present invention.

FIG. 2 is a partly side elevation and partly vertical se Tional view of a stud frame wall incorporating a plurality of concrete masonry blocks stacked on top of each other from the floor to the ceilng using the CM blocks and stud wall arrangement shown in FIGS. 1, 3 and 4.

FIG. 3 is a partly top plan and partly sectional view of part of a stud wall construction shown in FIGS. 1 and 2 with the CM blocks held in place by metal angles nailed to the studs and with an electrical junction box and cable illustrated.

FIG. 4 is a partly top plan and partly sectional view of part of a stud wall construction shown in FIGS. 1–2 in which the CM blocks are secured to the studs by wood strips and metal angle strips.

Reference is now made particularly to FIGS. 1–4 for the following description of a stud wall incorporating concrete masonry blocks according to the present invention. In FIGS. 1–4 there is shown part of such a wall section which includes a conventional stud wall frame construction comprising a base stud plate 10 extending along and secured to the floor 12 and a pair of upper stud plates 14 and 15 extending along and secured to the ceiling 16. A plurality of studs 18 extend vertically between, and are secured at their ends to, the floor stud plate 10 and the ceiling stud plates 14 and 15. In FIGS. 1–4, the floor stud plate, the ceiling stud plates, and the studs are shown to be made of wood; these members usually are $1\frac{1}{2}\times3\frac{1}{2}$ inches in cross-sectional size in the U.S. The studs 18 are spaced 16 inches on center according to standard U.S. practice. A stud wall frame incorporating such members 10, 14, 15, and 18 is of conventional type and the construction thereof will be apparent to those in the art from the description herein.

The configuration of the concrete masonry blocks for use in the stud wall construction of FIGS. 1–4 will be apparent from examination of FIGS. 1 and 3 to which reference is now made. Concrete masonry blocks indicated generally by arrow 20 are of a modified substantially rectangular parallelepiped shape as shown in FIGS. 1 and 3. Each block 20 has a first section 22 extending the overall length of the block, and a second shorter section 24. The second shorter section 24 has two end surfaces 26 disposed at an angle to end block portions 28 which constitute the ends of said first block section 22. Thus, CM block 20 has a main central portion 25 of major thickness including the thickness of both sections 22 and 24 (shown at f in FIG. 4), plus end portions 28 of reduced thickness (shown at g in FIG. 4 discussed below). In a sense, CM block 20 may be considered as comprising a trapezoidal portion 24 extending laterally from and along the central part of a rectangular portion 22. This configuration of block 20 provides offsets or recesses 29 adjacent ends 28 of block 20; and such recesses 29 will accommodate installation of electrical junction boxes within the stud wall framing as shown at 30 in FIG. 3. Also the angled surfaces 26 and recesses 29 near the ends of blocks 20 enable driving nails into the studs 18 and otherwise facilitate working in the space between adjacent studs and blocks 20 which have been disposed between the studs. As shown in FIG. 3 the blocks 20 are secured to the studs 18 by a plurality of metal angle strips 32 held in place by nails 34. Preferably the block retaining strips 32 are of a length equal to 3 or 4 times the height of CM blocks 20 to hold in place 3 or 4 vertically stacked blocks 20 to avoid toppling during installation. Also the block retaining strips 32 are designed so they may be applied on both sides of the blocks 20 in seismic area, or may be applied to one side of the blocks 20 in non-seismic areas.

The CM blocks 20 are disposed near one longitudinally extending edge 33 of the floor base plate 10 whereby the CM blocks 20 are assembled within the stud frame wall along one side of the wall. This provides a space or cavity such as indicated at 36 along the other side of the stud wall to accommodate electrical conduits such as illustrated at 38 as well as junction boxes 30 and like items which are used in conventional stud wall frame construction.

Referring to FIGS. 1 and 2 particularly, a vertical series of blocks 20 are stacked one on top of the other between the floor base plate 10 and the ceiling plates 14 and 15 within the space between adjacent studs 18. Wallboard shown at 40 is applied on both sides of the stud wall framing to enclose the wall in like manner as is done with conventional stud walls.

Referring to FIG. 4, the embodiment disclosed therein is substantially like that of the embodiment of FIG. 3 described above, and like numerals are used in FIG. 4 for like parts as in FIGS. 1–3. FIG. 4 illustrates that the CM blocks 20 may be held in place by wooden strips shown at 42 nailed into studs 18 by nails 34. As shown in FIG. 4, wooden strips 42 may also be used with metal strips 32. Wooden strips 42 may be of a length 3 or 4 times the height of CM blocks 20 to hold in place 3 or 4 vertically stacked blocks 20.

The CM blocks 20 may be mechanically installed in a stud wall using either metal strips 32 or wood strips 42 in the manner described without the use of mortar and without a skilled bricklayer or mason. If necessary or desirable, the CM blocks 20 may also be removed and are reusable due to their mechanical installation.

Reference is made particularly to FIG. 4 and also FIG. 2 wherein dimensional relationships of portions of a CM block 20 are indicated by letters (a)–(i). In an illustrative suitable commercial embodiment, the dimensions of various components of block 20 would be as follows:

dimension a of overall length of block 20 is 14 inches;
dimension b of the length of end portion 28 plus sloping portion 26 is 3 inches;
dimension c of the center portion of the trapezoidal portion of block 20 is 8 inches;

dimension d of the linear extent of sloping section 26 is 1 inch;

dimension e of the linear length of end section 28 is 2 inches;

dimension f of the overall thickness of block 20 is $2\frac{5}{8}$ inches;

dimension g of the thickness of the end sections 28 is $1\frac{1}{2}$ inches;

dimension h (the difference between dimension f and dimension g) is $1\frac{1}{8}$ inches; and dimension i of the height of the block (indicated at i in FIG. 2) is $7\frac{5}{8}$ inches.

The dimensions of blocks 20 herein-described are suitable for a conventional U.S. stud wall frame construction in which 2×4 studs which are $1\frac{1}{2}$ inches by $3\frac{1}{2}$ inches in size are mounted vertically on 16 inch centers. Such dimensions could be modified to some extent while still utilizing the present invention. Also, such dimensions could be modified for different stud wall framing dimensional relations, e.g. in metric countries, in a manner which will be apparent from the disclosure herein to one skilled in the art.

Using good current practice the concrete masonry blocks 20 would be made with a concrete cementitious material averaging over 100 lbs. per cubic foot density. Concrete masonry blocks 20 made of such material and with dimensions as described above provide desirable thermal storage capabiities and advantages while also meeting other requirements with respect to strength, weight, convenience of use in the field, etc. However, it is noted that the materials usable to make such concrete masonry blocks 20 for stud wall construction according to the present invention may in the future vary depending on future developments.

The invention may be embodied in other specific forms without departing from the spirit or essential characteristics thereof. The present embodiments are, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. A concrete masonry block and stud wall comprising, in combination:

a stud wall frame construction including a plurality of laterally spaced studs which extend vertically between a floor and a ceiling and have opposite edges on which wallboard may be mounted;

at least one electric junction box mounted adjacent one of the studs and electric cable connected to the box;

a plurality of concrete masonry blocks each having a substantially rectangular parallelepiped shape disposed between pairs of adjacent spaced studs and between said opposite edges of said studs, with said blocks being stacked vertically between floor and ceiling; said blocks being made of concrete masonry block casted cementitious material averaging over 100 pounds per cubic foot density wherein said concrete masonry blocks have a thickness dimension sufficiently less than a distance between said opposite edges of the studs so that there is sufficient space for installation of said electrical cable and the like between a side of said stacked concrete masonry blocks and wallboard installed on sides of said studs near said side of said blocks, opposite end portions of at least some of said blocks being formed with a recess establishing reduced thickness end portions, said at least one junction box being mounted within said recess without interfering with flush placement of wallboard against the studs.

2. A concrete masonry block and sturd wall according to claim 1, wherein:

each of said substantially rectangular blocks has at least one end portion of reduced thickness providing a recess in the block near the end thereof.

3. A concrete masonry block and stud wall according to claim 1, wherein:

each of said substantially rectangular blocks has at each of two ends thereof a portion of reduced thickness providing a recess in the block near each end thereof.

4. A concrete masonry block and stud wall according to claim 3, wherein:

each said block includes two surfaces extending at an angle between a main thicker portion of said block and said block end portions of reduced thickness which provide a recess in each of said blocks near each end thereof.

5. A concrete masonry block and stud wall according to claim 1 further comprising:

a plurality of strips secured to inside surface of adjacent studs and abutting opposite ends of said blocks on at least one side of said blocks to secure said blocks in said stud wall framing.

6. A concrete masonry block and stud wall according to claim 5 wherein:

each of said strips is of a length equal to a height of a plurality of said vertically stacked concrete masonry blocks.

7. A concrete masonry block and stud wall according to claim 5 wherein:

said plurality of strips are secured to said studs on two opposite sides of said vertically stacked blocks and at both ends of said vertically stacked blocks.

8. A concrete masonry block and stud wall according to claim 5 wherein said strips are made of metal angles.

9. A concrete masonry block and stud wall according to claim 5 wherein said strips are made of wood.

10. A concrete measonry block and stud wall according to any of claims 1 to 4 further comprising:

wallboard secured to opposite sides of said studs enclosing said concrete masonry blocks stacked between adjacent studs.

11. A concrete masonry block and stud wall comprising, in combination:

a stud wall frame construction including a plurality of laterally spaced studs which extend vertically between a floor and a ceiling and have opposite edges on which wallboard may be mounted;

at least one electric junction box mounted adjacent one of the studs and electric cable connected to the box;

a plurality of concrete masonry blocks each having a substantially rectangular parallelepiped shape disposed between pairs of adjacent spaced studs and between opposite edges of said studs, with said blocks being stacked vertically between floor and ceiling, said blocks being made of concrete masonry blocked casted cementitious material averaging over 100 pounds per cubic foot density;

each of said substantially rectangular blocks having at each of two ends thereof a portion of reduced thickness providing a recess in the block near each end thereof;

each of said concrete masonry blocks being installed with one side thereof substantially in line with one of said edges of the studs and said blocks having a thickness dimension sufficiently less than the distance between said opposite edges of the studs so that there is sufficient space for installation of electrical cable and the like between a second side of said stacked concrete masonry blocks and wallboard installed on the sides of said studs near said second side of said blocks;

the reduction in thickness at the end of each of the concrete masonry blocks and the recess in the second side thereby provided being sufficient to accommodate said electric junction box when wallboard is applied to the sides of the studs near said second side of said blocks by flush placement of the wallboared against said studs.

12. A concrete masonry block and stud wall according to claim 11 further comprising:

a plurality of strips secured to the inside of adjacent studs and abutting opposite ends of said blocks on at least one side of said blocks to secure said blocks in said stud wall framing;

each of said strips being of a length equal to the height of a plurality of said vertically stacked concrete masonry blocks.

13. A concrete masonry block and stud wall according to either of claims 11 or 12 further comprising:

wallboard secured to opposite sides of said studs enclosing said concrete masonry blocks stacked between adjacent studs.

* * * * *